US009598659B2

(12) United States Patent
Yagishita et al.

(10) Patent No.: US 9,598,659 B2
(45) Date of Patent: Mar. 21, 2017

(54) HYDRAULIC FLUID COMPOSITION

(71) Applicant: JX NIPPON OIL & ENERGY CORPORATION, Chiyoda-ku, Tokyo (JP)

(72) Inventors: Kazuhiro Yagishita, Tokyo (JP); Toru Hirano, Tokyo (JP); Tadashi Oshio, Tokyo (JP)

(73) Assignee: JX NIPPON OIL & ENERGY CORPORATION, Chiyoda-Ku (JP)

( * ) Notice: Subject to any disclaimer, the term of this patent is extended or adjusted under 35 U.S.C. 154(b) by 0 days.

(21) Appl. No.: 14/767,013

(22) PCT Filed: Mar. 25, 2014

(86) PCT No.: PCT/JP2014/058278
§ 371 (c)(1),
(2) Date: Aug. 11, 2015

(87) PCT Pub. No.: WO2014/157200
PCT Pub. Date: Oct. 2, 2014

(65) Prior Publication Data

US 2015/0376541 A1 Dec. 31, 2015

(30) Foreign Application Priority Data

Mar. 25, 2013 (JP) ..... 2013-062515

(51) Int. Cl.
*C10M 145/14* (2006.01)
*C10M 169/04* (2006.01)

(52) U.S. Cl.
CPC ..... *C10M 145/14* (2013.01); *C10M 169/041* (2013.01); *C10M 2203/1006* (2013.01); *C10M 2203/1025* (2013.01); *C10M 2207/026* (2013.01); *C10M 2209/084* (2013.01); *C10M 2223/041* (2013.01); *C10N 2220/021* (2013.01); *C10N 2220/022* (2013.01); *C10N 2230/02* (2013.01); *C10N 2230/06* (2013.01); *C10N 2230/43* (2013.01); *C10N 2230/68* (2013.01); *C10N 2240/08* (2013.01)

(58) Field of Classification Search
CPC ..... C10N 2220/021; C10N 2220/022; C10N 2230/02; C10N 2230/06; C10N 2230/43; C10N 2230/68; C10N 2240/08
See application file for complete search history.

(56) References Cited

U.S. PATENT DOCUMENTS 4,776,967 A * 10/1988 Ichihashi ..... C10M 169/048 508/185
2014/0011724 A1* 1/2014 Onumata ..... C10M 145/14 508/469

FOREIGN PATENT DOCUMENTS

| | | | |
|---|---|---|---|
| CN | 101970626 | A | 2/2011 |
| CN | 102239241 | A | 11/2011 |
| CN | 102459546 | A | 5/2012 |
| JP | 2005154760 | A | 6/2005 |
| JP | 2005307197 | A | 11/2005 |
| JP | 2007197509 | A | 8/2007 |
| JP | 2011046900 | A | 3/2011 |
| JP | 2012180535 | A | 9/2012 |
| WO | 2006009083 | A1 | 1/2006 |
| WO | 2012132054 | A1 | 10/2012 |

OTHER PUBLICATIONS

International Preliminary Report on Patentability issued Sep. 29, 2015, corresponding to PCT/JP2014/058278.

* cited by examiner

*Primary Examiner* — Cephia D Toomer
(74) *Attorney, Agent, or Firm* — Andrews Kurth Kenyon LLP

(57) ABSTRACT

The present invention provides a hydraulic oil composition comprising: a lubricating base oil having a kinematic viscosity at 40° C. of 15 to 50 $mm^2/s$; and 1 to 40% by mass, based on a total amount of the hydraulic oil composition, of a polymethacrylate having a number-average molecular weight of 48000 or lower, the hydraulic oil composition having a viscosity index of 150 or higher, and a ratio (A/B) at 60 to 80° C. of (A) a kinematic viscosity (unit: $mm^2/s$) to (B) a shear viscosity (unit: mPa·s, shear condition: $10^6/s$) of 1.3 or lower.

2 Claims, No Drawings

HYDRAULIC FLUID COMPOSITION

CROSS-REFERENCE TO RELATED APPLICATIONS

This is a national phase application based on the PCT International Patent Application No. PCT/JP2014/058278 filed Mar. 25, 2014, claiming priority to Japanese Patent Application No. 2013-062515 filed Mar. 25, 2013, the entire contents of both of which are incorporated herein by reference.

TECHNICAL FIELD

The present invention relates to a hydraulic oil composition. The present invention relates particularly to a hydraulic oil composition containing a viscosity index improver and having a high energy efficiency.

BACKGROUND ART

In recent years, energy-saving hydraulic oils have been developed as one of responses to global warming. There are some conventional energy-saving hydraulic oils allowing achieving the reduction of energy consumption of apparatuses at starting, for example, by decreasing their low-temperature viscosity.

There are also developed energy-saving hydraulic oils whose viscosity change is made small by blending a viscosity index improver to thereby reduce energy consumption in the steady-state operation after the fluid temperature is raised. In the energy-saving hydraulic oils, the fluid leakage (internal leakage) from construction machines' characteristic various hydraulic apparatus interiors is prevented by making small the viscosity change (making the viscosity index high) of the hydraulic oils, and the reduction of the energy consumption is achieved (for example, see Patent Literatures 1 to 3).

CITATION LIST

Patent Literature

Patent Literature 1: Japanese Patent Application Laid-Open No. 2005-307197

Patent Literature 2: Japanese Patent Application Laid-Open No. 2011-046900

Patent Literature 3: Japanese Patent Application Laid-Open No. 2012-180535

SUMMARY OF INVENTION

Technical Problem

In the case of the energy-saving hydraulic oils as described in the above Patent Literatures 1 to 3, however, the high viscosity index of the hydraulic oils causes an increase in the loss due to the plumbing resistance. Hence, even if the energy consumption can be reduced by the internal leakage prevention, there is still room for improvement in the point of improving the energy efficiency of the hydraulic system as a whole.

The present invention has been achieved in consideration of such a real situation, and an object thereof is to provide a hydraulic oil composition enabling both the internal leakage prevention and the plumbing resistance reduction to be compatibly achieved, and enabling the energy efficiency of a hydraulic system as a whole to be improved.

Solution to Problem

As a result of exhaustive studies, the present inventors have found a composition exhibiting excellent viscosity characteristics compatibly achieving both the internal leakage prevention and the plumbing resistance reduction of a hydraulic system, and this finding has led to the completion of the present invention.

That is, the present invention provides a hydraulic oil composition comprising: a lubricating base oil having a kinematic viscosity at 40° C. of 15 to 50 $mm^2/s$; and 1 to 40% by mass, based on a total amount of the hydraulic oil composition, of a polymethacrylate having a number-average molecular weight of 48000 or lower, the hydraulic oil composition having a viscosity index of 150 or higher, and a ratio (A/B) at 60 to 80° C. of (A) a kinematic viscosity (unit: $mm^2/s$) to (B) a shear viscosity (unit: mPa·s, shear condition: $10^6/s$) of 1.3 or lower.

It is preferable that the sulfur content of the lubricating base oil is 10 ppm by mass or lower.

Advantageous Effects of Invention

The hydraulic oil composition according to the present invention enables both the internal leakage prevention and the plumbing resistance reduction to be compatibly achieved, and exhibits a remarkable effect of enabling the energy efficiency of a hydraulic system as a whole to be improved.

DESCRIPTION OF EMBODIMENTS

Hereinafter, a preferred embodiment according to the present invention will be described.

A hydraulic oil composition according to the present embodiment is a hydraulic oil composition comprising a lubricating base oil having a kinematic viscosity at 40° C. of 15 to 50 $mm^2/s$, and 1 to 40% by mass based on the total amount of the hydraulic oil composition of a polymethacrylate having a number-average molecular weight of 48000 or lower, wherein the hydraulic oil composition has the viscosity index of 150 or higher, and the ratio (A/B) at 60 to 80° C. of (A) a kinematic viscosity (unit: $mm^2/s$) to (B) a shear viscosity (unit: mPa·s, shear condition: $10^6/s$) of 1.3 or lower.

The lubricating base oil to be used in the present embodiment includes mineral oils, synthetic hydrocarbon oils, synthetic oxygen-containing oils, and fats and oils. These lubricating base oils can be used singly or in combinations of two or more.

The mineral oil is not especially limited, but examples thereof include paraffinic mineral oils or naphthenic mineral oils refined by subjecting lubricating oil fractions obtained by atmospheric pressure distillation and reduced pressure distillation of crude oils to suitably combined refining treatments including solvent deasphalting, solvent extraction, hydrocracking, solvent dewaxing, catalytic dewaxing, hydrorefining, sulfuric acid cleaning and clay treatment.

Examples of the synthetic hydrocarbon oil include poly-α-olefins (polybutene, 1-octene oligomers, 1-decene oligomers and the like), alkylbenzenes and alkylnaphthalenes.

As the synthetic oxygen-containing oil, there are used, for example, esters such as monoesters of a monohydric alcohol and a monovalent fatty acid, and polyol esters of a polyhydric alcohol and a monovalent fatty acid; and polyoxyalkylene glycols.

As the fats and oils, there are used, for example, vegetable fats and oils such as palm oil, palm kernel oil, rapeseed oil, soybean oil, high oleic rapeseed oil and high oleic sunflower oil.

Among these, mineral oils and synthetic hydrocarbon oils are preferably used and mineral oils are more preferably used.

The kinematic viscosity at 40° C. of the lubricating base oil is 15 to 50 $mm^2/s$, but is preferably 20 to 45 $mm^2/s$, and more preferably 25 to 40 $mm^2/s$. When the kinematic viscosity at 40° C. is lower than 15 $mm^2/s$, the case is not preferable in the points of a decrease in the flash point, and the evaporation. When the kinematic viscosity at 40° C. exceeds 50 $mm^2/s$, the case is not preferable because the plumbing resistance increases.

The viscosity index of the lubricating base oil is not especially limited, but is preferably 100 or higher, more preferably 110 or higher, still more preferably 120 or higher, and most preferably 125 or higher. When the viscosity index is 100 or higher, since the kinematic viscosity at low temperatures is suppressed in becoming high when the kinematic viscosity at high temperatures is secured, the case is preferable in the point of being capable of suppressing the efficiency decrease of a hydraulic system. On the other hand, the upper limit value of the viscosity index is not especially limited, but is, for example, 250.

Here, the "kinematic viscosity" and the "viscosity index" in the present specification mean values measured according to JIS K 2283.

The sulfur content of the lubricating base oil is not especially limited, but is preferably 50 ppm by mass or lower, more preferably 10 ppm by mass or lower, and still more preferably 5 ppm by mass or lower. When the sulfur content is 50 ppm by mass or lower, the case is preferable in the points of the oxidation stability and the corrosion resistance.

The content of the lubricating base oil is preferably 40% by mass or higher, more preferably 50% by mass or higher, and still more preferably 70% by mass or higher based on the total amount of the hydraulic oil composition. Further the content of the lubricating base oil is preferably 99% by mass or lower, more preferably 98% by mass or lower, and still more preferably 95% by mass or lower based on the total amount of the hydraulic oil composition. When the content of the lubricating base oil is 40% by mass or higher, the excellent advantages of the hydraulic oil are easily fully exhibited.

As the polymethacrylate which the hydraulic oil composition according to the present embodiment contains, there can be used either of a non-dispersive polymethacrylate represented by the following formula (1) and a dispersive polymethacrylate represented by the following formula (2).

[Chemical Formula 1]

(1)

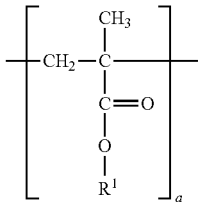

In the above formula (1), a is an integer of 1 or more, and is an integer such that the number-average molecular weight of the polymethacrylate represented by the above formula (1) is 48000 or lower; and $R^1$ represents an alkyl group having 1 to 22 carbon atoms.

[Chemical Formula 2]

(2)

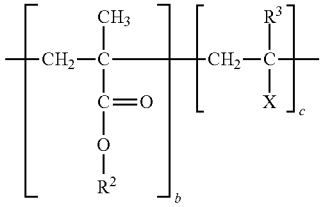

In the above formula (2), b and c are each an integer of 1 or more, and are integers such that the number-average molecular weight of the polymethacrylate represented by the above formula (2) is 48000 or lower; $R^2$ represents an alkyl group having 1 to 22 carbon atoms; $R^3$ represents hydrogen or a methyl group; and X represents a polar group.

The number-average molecular weight of the polymethacrylate is 48000 or lower, but is preferably 45000 or lower, and more preferably 40000 or lower. The lower limit value of the number-average molecular weight of the polymethacrylate is not especially limited, but is preferably 2000 or higher, more preferably 5000 or higher, and still more preferably 10000 or higher. When the number-average molecular weight of the polymethacrylate is 48000 or lower, the case is preferable in the point of an effect of improving the high shear viscosity; and when that is 2000 or higher, the case is preferable in the point of an effect of improving the viscosity index.

The content of the polymethacrylate is 1 to 40% by mass. The content of the polymethacrylate is preferably 3% by mass or higher, more preferably 5% by mass or higher, and still more preferably 10% by mass or higher based on the total amount of the hydraulic oil composition. Further the content of the polymethacrylate is preferably 35% by mass or lower, more preferably 30% by mass or lower, and still more preferably 23% by mass or lower. When the content of the polymethacrylate is 1% by mass or higher, the case is preferable in the point of an effect of improving the high shear viscosity; and when that is 35% by mass or lower, the case is preferable in the point of the economical merit.

The kinematic viscosity at 40° C. of the hydraulic oil composition is not especially limited, but is preferably 20 $mm^2/s$ or higher, more preferably 30 $mm^2/s$ or higher, still more preferably 40 $mm^2/s$ or higher, and most preferably 41.4 $mm^2/s$ or higher. Further the kinematic viscosity at 40° C. is preferably 80 $mm^2/s$ or lower, more preferably 70 $mm^2/s$ or lower, still more preferably 60 $mm^2/s$ or lower, and most preferably 50.6 $mm^2/s$ or lower. When the kinematic viscosity at 40° C. of the hydraulic oil composition is 20 $mm^2/s$ or higher, the case is preferable in the point of the durability of a hydraulic system; and when that is 80 $mm^2/s$ or lower, the case is preferable in the point of the friction reduction.

In the hydraulic oil composition in the present embodiment, the ratio (A/B) at 60 to 80° C. of (A) a kinematic viscosity (unit: $mm^2/s$) to (B) a shear viscosity (unit: mPa·s, shear condition: $10^6/s$) is 1.3 or lower. The above ratio (A/B) is preferably 1.25 or lower, and more preferably 1.2 or lower.

When the above ratio (A/B) exceeds 1.3, the case is not preferable in the points of the pump efficiency and the plumbing resistance. On the other hand, the lower limit value of the above ratio (A/B) is not especially limited, but is, for example, 1.1.

Here, the "shear viscosity" in the present specification means a value measured according to ASTM (D4741, D4683, D6616), CEC (L-36A-90).

The hydraulic oil composition according to the present embodiment, in order to more improve its excellent advantages, can further comprise, as required, an extreme pressure agent, an antioxidant, a pour point depressant, a rust-preventive agent, a metal deactivator, a viscosity index improver, an antifoaming agent, a demulsifier, an oiliness agent and the like. These additives may be used singly or in combinations of two or more.

The extreme pressure agent includes sulfur compounds such as ester sulfides, sulfurized fats and oils and polysulfides, zinc dithiophosphate, and phosphorus compounds, and it is preferable that phosphorus compounds are used. The phosphorus compounds specifically include phosphate esters, acidic phosphate esters, amine salts of acidic phosphate esters, chlorinated phosphate esters, phosphite esters and phosphorothionate. The phosphorus compounds include esters of phosphoric acid, phosphorous acid or thiophosphoric acid with an alkanol or a polyetheric alcohol, and their derivatives.

Among the above phosphorus compounds, since higher antiwear property can be provided, phosphate esters, acidic phosphate esters, amine salts of acidic phosphate esters are preferable, and among these, phosphate esters are more preferable. It is preferable that the content of the extreme pressure agent is 0.05 to 5% by mass based on the total amount of the hydraulic oil composition.

Examples of the antioxidant include phenolic compounds such as 2,6-ditertiary-butyl-p-cresol (DBPC), aromatic amines such as phenyl-α-naphthylamine, hindered amine compounds, phosphite esters and organometal compounds. It is preferable that the content of the phenolic antioxidant is 0.01 to 2% by mass based on the total amount of the hydraulic oil composition. Further it is preferable that the content of the amine-based antioxidant is 0.001 to 2% by mass based on the total amount of the hydraulic oil composition.

Examples of the pour point depressant are copolymers of at least one monomer selected from acrylate esters and methacrylate esters, and hydrogenated substances thereof. It is preferable that the content of the pour point depressant is 0.01 to 5% by mass based on the total amount of the hydraulic oil composition.

Examples of the rust-preventive agent are amino acid derivatives, partial esters of polyhydric alcohols; esters such as lanolin fatty acid esters, alkyl succinate esters and alkenyl succinate esters; sarcosine; polyhydric alcohol partial esters such as sorbitan fatty acid esters; metal soaps such as fatty acid metal salts, lanolin fatty acid metal salts and oxidized wax metal salts; sulfonates such as calcium sulfonate and barium sulfonate; oxidized waxes; amines; phosphoric acid; and phosphate salts. It is preferable that the content of the rust-preventive agent is 0.01 to 5% by mass based on the total amount of the hydraulic oil composition.

Examples of the metal deactivator are benzotriazole compounds, thiadiazole compounds and imidazole compounds. It is preferable that the content of the metal deactivator is 0.001 to 1% by mass based on the total amount of the hydraulic oil composition.

The hydraulic oil composition according to the present embodiment can further comprise a viscosity index improver other than the above polymethacrylate. Specific examples thereof include non-dispersive viscosity index improvers such as copolymers of at least one monomer selected from methacrylate esters and hydrogenated substances thereof, polyisobutylenes and hydrogenated substances thereof, hydrogenated styrene-diene copolymers and polyalkylstyrenes. It is preferable that the content of the viscosity index improver other than the above copolymers is 0.01 to 15% by mass based on the total amount of the hydraulic oil composition.

Examples of the antifoaming agent are silicones such as dimethylsilicones and fluorosilicones. It is preferable that the content of the antifoaming agent is 0.001 to 0.05% by mass based on the total amount of the hydraulic oil composition.

Examples of the demulsifier include polyoxyalkylene glycols, polyoxyalkylene alkyl ethers, polyoxyalkylene alkylamides and polyoxyalkylene fatty acid esters.

The oiliness agent includes fatty acids, esters and alcohols. It is preferable that the content of the oiliness agent is 0.01 to 0.5% by mass based on the total amount of the hydraulic oil composition.

EXAMPLES

Hereinafter, the present invention will be described more specifically by way of Examples and Comparative Examples, but the present invention is not any more limited to these contents.

In Examples 1 to 3 and Comparative Examples 1 to 3, hydraulic oil compositions were each prepared by blending a lubricating base oil and additives in a composition shown in Table 1 and Table 2. In the preparation of the hydraulic oil composition, the 40° C. kinematic viscosity was regulated so that the ISO viscosity grade became VG46. That is, the amount of a viscosity index improver to be blended was regulated according to its molecular weight; and in the case where no viscosity index improver was blended, a base oil of VG46 was used. The lubricating base oils and the additives used in the Examples and the Comparative Examples are as follows.

<Lubricating Base Oils>

Base oil 1: hydrorefined mineral oil (total aromatic content: 0.0% by mass, sulfur content: 10 ppm by mass or lower, 40° C. kinematic viscosity: 26 $mm^2/s$, viscosity index: 131)

Base oil 2: hydrorefined mineral oil (total aromatic content: 0.0% by mass, sulfur content: 10 ppm by mass or lower, 40° C. kinematic viscosity: 46 $mm^2/s$, viscosity index: 127)

Here, the total aromatic content was measured according to silica-alumina gel chromatography described in "Separation of High-Boiling Petroleum Distillates Using Gradient Elution Through Dual-Packed (Silica Gel-Alumina Gel) Adsorption Columns," Analytical Chemistry, Vol. 44, No. 6, (1972), pp. 915-919.

Further the sulfur content was measured according to ASTM D4951, "Standard Test Method for Determination of Additive Elements in Lubricating Oils by Inductively Coupled Plasma Atomic Emission Spectrometry."

Further the kinematic viscosity and the viscosity index were measured according to JIS K 2283.

<Viscosity Index Improvers>

A: a polymethacrylate (manufactured by Evonik Degussa GmbH, JMB3587, number-average molecular weight: 20000)

B: a polymethacrylate (manufactured by Sanyo Chemical Industries, Ltd., Aclube V815, number-average molecular weight: 20000)

C: a polymethacrylate (manufactured by Henkel Japan Ltd., Kanelube 2091, number-average molecular weight: 40000)

D: a polymethacrylate (manufactured by Evonik Degussa GmbH, VISCOPLEX 1-156, number-average molecular weight: 50000)

E: a polymethacrylate (manufactured by Sanyo Chemical Industries, Ltd., Aclube H-3300, number-average molecular weight: 100000)

<Other Additives>

In Examples 1 to 3 and Comparative Examples 1 to 3, as other additives, tricresyl phosphate, 2,6-ditertiary-butyl-p-cresol (DBPC) and a pour point depressant were each blended in 0.5% by mass based on the total amount of the hydraulic oil composition.

Each property was measured for each hydraulic oil composition obtained in Examples 1 to 3 and Comparative Examples 1 to 3 as described below. The results are shown in Table 1 and Table 2.

The kinematic viscosity and the viscosity index: which were measured according to JIS K 2283.

The shear viscosity: which was measured according to ASTM (D4741, D4683, D6616), CEC (L-36A-90), at 60, 70, and 80° C. at a shear condition of $10^6$/s. A measuring instrument used was a USV (Ultra Shear Viscometer) viscometer, manufactured by PCS Instruments.

[HPV35+35 Pump Test]

An HPV35+35 pump test was carried out on each hydraulic oil composition obtained in Examples 1 to 3 and Comparative Examples 1 to 3. Specifically, the rotational torque of the pump was measured under the following test condition, and the total efficiency was calculated. The results are shown in Table 1 and Table 2.

The pump name: Komatsu HPV35+35

The discharge volume+the drain volume: 40 L/min

The pump type: a swash plate type

The oil temperature: 80° C.

The pressure: no load, 35 MPa

The rotation of the pump: 2100 rpm

TABLE 1

| | | Example 1 | Example 2 | Example 3 |
|---|---|---|---|---|
| Composition (% by mass) | base oil 1 | balance | balance | balance |
| | base oil 2 | — | — | — |
| | viscosity index improver A | 16 | — | — |
| | viscosity index improver B | — | 19 | — |
| | viscosity index improver C | — | — | 15 |
| | viscosity index improver D | — | — | — |
| | viscosity index improver E | — | — | — |
| | tricresyl phosphate | 0.5 | 0.5 | 0.5 |
| | DBPC | 0.5 | 0.5 | 0.5 |
| | pour point depressant | 0.5 | 0.5 | 0.5 |
| Properties | kinematic viscosity at 40° C. ($mm^2$/s) | 46.20 | 45.82 | 46.91 |
| | kinematic viscosity at 60° C. ($mm^2$/s) | 23.53 | 23.36 | 24.82 |
| | kinematic viscosity at 70° C. ($mm^2$/s) | 17.72 | 17.60 | 18.95 |
| | kinematic viscosity at 80° C. ($mm^2$/s) | 13.74 | 13.65 | 14.85 |
| | kinematic viscosity at 100° C. ($mm^2$/s) | 8.87 | 8.81 | 9.75 |
| | viscosity index | 175 | 176 | 200 |
| | shear viscosity at 60° C. (mPa · s) | 20.35 | 19.61 | 19.98 |
| | shear viscosity at 70° C. (mPa · s) | 15.17 | 15.04 | 15.37 |
| | shear viscosity at 80° C. (mPa · s) | 11.69 | 11.64 | 12.10 |
| | kinematic viscosity at 60° C./shear viscosity at 60° C. | 1.16 | 1.19 | 1.24 |
| | kinematic viscosity at 70° C./shear viscosity at 70° C. | 1.17 | 1.17 | 1.23 |
| | kinematic viscosity at 80° C./shear viscosity at 80° C. | 1.18 | 1.17 | 1.23 |
| Total Efficiency (%) of HPV35 + 35 Pump Test [35 MPa, 80° C.] | | 66.6 | 66.5 | 66.7 |

TABLE 2

| | | Comparative Example 1 | Comparative Example 2 | Comparative Example 3 |
|---|---|---|---|---|
| Composition (% by mass) | base oil 1 | — | balance | balance |
| | base oil 2 | balance | — | — |
| | viscosity index improver A | — | — | — |
| | viscosity index improver B | — | — | — |
| | viscosity index improver C | — | — | — |
| | viscosity index improver D | — | 10 | — |
| | viscosity index improver E | — | — | 10 |
| | tricresyl phosphate | 0.5 | 0.5 | 0.5 |
| | DBPC | 0.5 | 0.5 | 0.5 |
| | pour point depressant | 0.5 | 0.5 | 0.5 |
| Properties | kinematic viscosity at 40° C. ($mm^2$/s) | 45.21 | 45.72 | 47.30 |
| | kinematic viscosity at 60° C. ($mm^2$/s) | 21.47 | 23.63 | 25.74 |

TABLE 2-continued

| | Comparative Example 1 | Comparative Example 2 | Comparative Example 3 |
|---|---|---|---|
| kinematic viscosity at 70° C. ($mm^2/s$) | 15.77 | 17.89 | 19.86 |
| kinematic viscosity at 80° C. ($mm^2/s$) | 11.98 | 13.93 | 15.70 |
| kinematic viscosity at 100° C. ($mm^2/s$) | 7.51 | 9.05 | 10.44 |
| viscosity index | 132 | 184 | 218 |
| shear viscosity at 60° C. (mPa · s) | 18.30 | 17.58 | 18.59 |
| shear viscosity at 70° C. (mPa · s) | 13.24 | 13.49 | 14.20 |
| shear viscosity at 80° C. (mPa · s) | 10.10 | 10.62 | 11.19 |
| kinematic viscosity at 60° C./shear viscosity at 60° C. | 1.17 | 1.34 | 1.38 |
| kinematic viscosity at 70° C./shear viscosity at 70° C. | 1.19 | 1.33 | 1.40 |
| kinematic viscosity at 80° C./shear viscosity at 80° C. | 1.19 | 1.31 | 1.40 |
| Total Efficiency (%) of HPV35 + 35 Pump Test [35 MPa, 80° C.] | 64.7 | 64.9 | 65.1 |

The invention claimed is:

1. A hydraulic oil composition comprising:

a lubricating base oil having a kinematic viscosity at 40° C. of 15 to 50 $mm^2/s$; and 15 to 40% by mass, based on a total amount of the hydraulic oil composition, of a polymethacrylate having a number-average molecular weight of 48000 or lower, the hydraulic oil composition having a viscosity index of 150 or higher, and a ratio (A/B) at 60 to 80° C. of (A) a kinematic viscosity (unit: $mm^2/s$) to (B) a shear viscosity (unit: mPa-s, shear condition: $10^6/s$) of 1.3 or lower.

2. The hydraulic oil composition according to claim 1, wherein a sulfur content of the lubricating base oil is 10 ppm by mass or lower.

* * * * *